US005465980A

United States Patent [19]

Maurin

[11] Patent Number: 5,465,980

[45] Date of Patent: Nov. 14, 1995

[54] ARROW WITH DEPLOYABLE SNARE

[76] Inventor: Edward E. Maurin, R.d. #2, Box 363A, Carmichaels, Pa. 15320

[21] Appl. No.: 381,747

[22] Filed: Feb. 1, 1995

Related U.S. Application Data

[63] Continuation-in-part of Ser. No. 172,185, Dec. 23, 1993, abandoned.

[51] Int. Cl.[6] ..... F42B 6/04

[52] U.S. Cl. ..... 273/416; 273/421

[58] Field of Search ..... 273/416, 418–423; 43/6, 7, 58

[56] References Cited

U.S. PATENT DOCUMENTS

| | | | |
|---|---|---|---|
| 2,848,834 | 8/1958 | Cox | 273/416 X |
| 2,970,839 | 2/1961 | Halverson | 273/416 |
| 4,252,325 | 2/1981 | Weems et al. | 273/416 |
| 4,651,999 | 3/1987 | Sturm | 273/416 |
| 4,836,557 | 6/1989 | Polando | 273/416 |
| 5,094,463 | 3/1992 | Dryden | 273/416 |
| 5,188,373 | 2/1993 | Ferguson et al. | 273/416 X |
| 5,314,196 | 5/1994 | Ruelle | 273/416 |

*Primary Examiner*—Paul E. Shapiro

[57] ABSTRACT

A new and improved arrow with deployable snare comprising a two-part hollow shaft having a coupling to releasably connect the two parts, a feathered stabilizer, a nock, an arrowhead, and a snare comprising a plurality of flexible filaments fixedly attached to each other, the filaments also being attached at one end to the inside of one of the hollow shafts, the filaments further being attached at the other end to the inside of the other hollow shaft, the filaments being stowed inside the hollow shaft, the filaments additionally having a length to deploy outside the hollow shaft upon release of the shaft coupling at the time of impact with a target whereby ensnarling the target so as to prevent loss of the target and the arrow.

5 Claims, 4 Drawing Sheets

ARROW WITH DEPLOYABLE SNARE

RELATED APPLICATION

This application is a Continuation-in-Part of U.S. patent application Ser. No. 08/172,185 filed Dec. 23, 1993, abandoned.

BACKGROUND OF THE INVENTION

1. Field of the Invention

The present invention relates to arrows and more particularly pertains to arrows with a deployable snare which may be utilized for preventing loss of a target and the arrow.

2. Description of the Prior Art

The use of arrows is known in the prior art. More specifically, arrows heretofore devised and utilized for the purpose of hunting and target shooting are known to consist basically of familiar, expected and obvious structural configurations, notwithstanding the myriad of designs encompassed by the crowded prior art which have been developed for the fulfillment of countless objectives and requirements. The present invention is directed to improving devices for hunting and target shooting with arrows in a manner which is safe, secure, economical and aesthetically pleasing.

For example, U.S. Pat. No. 3,945,642 to Henthorn, Jr. discloses an arrow with a substantially rigid shield slidably mounted on the shank for retarding motion of the arrow entering an animal or other target. U.S. Pat. No. 4,905,397 to Juelg, Jr. describes an arrow with a game or fish stop comprising a block of rubber-like material having a passage therethrough frictionally gripping an arrow shaft adjacent to the point end. U.S. Pat. No. 5,022,658 to Burkhardt shows an arrow penetrator brake assembly operable to provide braking friction when passing through game or into a brush area. The three disclosures mentioned heretofore make no provision for ensnaring the target to prevent escape or loss.

U.S. Pat. No. 4,111,424 to Schreiber et al describes an arrow and arrow attachment which includes outwardly projecting components acted upon by the slipstream to inhibit arrow flight. The device described in the disclosure does not teach a way for deployment of a snare upon impact with a target and the benefit derived therefrom whereby the target is entangled to prevent loss of the target and the arrow.

In this respect, the arrow with deployable snare according to the present invention substantially departs from the conventional concepts and designs of the prior art, and in so doing provides an apparatus primarily developed for the purpose of preventing loss of a target and the arrow.

Therefore, it can be appreciated that there exists a continuing need for new and improved arrows which can be used to can be utilized for preventing loss of a target and the arrow. In this regard, the present invention substantially fulfills this need.

As illustrated by the background art, efforts are continuously being made in an attempt to devise apparatus to improve the usefulness of arrows. No prior effort, however, provides the benefits attendant with the present invention. Additionally, the prior patents and commercial techniques do not suggest the present inventive combination of component elements arranged and configured as disclosed and claimed herein.

The present invention achieves its intended purposes, objects, and advantages through a new, useful and unobvious combination of method steps and component elements, with the use of a minimum number of functioning parts, at a reasonable cost to manufacture, and by employing only readily available materials.

SUMMARY OF THE INVENTION

In view of the foregoing disadvantages inherent in the known types of arrows now present in the prior art, the present invention provides an improved arrow with deployable snare construction wherein the same can be utilized for preventing loss of a target and the arrow. As such, the general purpose of the present invention, which will be described subsequently in greater detail, is to provide a new and improved arrow with deployable snare and method which has all the advantages of the prior arrows and none of the disadvantages.

The invention is defined by the appended claims with the specific embodiment shown in the attached drawings. For the purpose of summarizing the invention, the invention may be incorporated into a new and improved arrow with a deployable snare comprised of a first tubular shaft having an outside diameter and an inside diameter wherein a hollow space is formed. The first shaft further has a wall defined by the difference between the outside diameter and the inside diameter. The first shaft additionally has a feathered stabilizer fixedly attached to one end, a nock fixedly attached to the same end as the feathered stabilizer, and an open end opposite the nock.

A second tubular shaft is also included, the shaft having essentially the same outside diameter as the first shaft and essentially the same inside diameter as the first shaft wherein a hollow space is formed, and also having a wall defined by the difference between the outside diameter and the inside diameter. The second shaft additionally has an arrowhead fixedly attached to one end and an open end opposite the arrowhead.

The arrow with deployable snare further includes a means to releasably couple the first shaft to the second shaft so when the first and second shafts are in coupled relationship they are aligned colinearly. The coupler comprises a cylindrical first element having a body with an outside diameter essentially the same as the inside diameter of the first shaft. The first element is fixedly attached to the open end of the first shaft so the body is contained entirely within the hollow space of the first shaft. A flange formed on one end of the body external to the first shaft to stop the arrow from passing entirely through a target thereby preventing loss of the arrow. The first element additionally has a longitudinal tapered hole therethrough, the tapered hole having a fixed taper angle with the largest opening at the end of the element having the flange. The tapered hole also has an inside diameter with two spaced annular grooves formed thereon.

A second cylindrical element having a body with an outside diameter essentially the same as the inside diameter of the second shaft is fixedly attached to the open end of the second shaft so the body is contained entirely within the hollow space of the second shaft. The second element also has a tapered rod extending from one end external to the second shaft. The tapered rod has a common axis with the body of the second cylindrical element. The tapered rod also has an outside diameter and a taper angle essentially complimentary to the inside diameter and taper angle of the first element's longitudinal tapered hole. The tapered rod additionally has two spaced annular rings formed thereon, the annular rings being configured to cooperatively releasably snapidly engage with the annular grooves of the first coupler element when the tapered rod is forcibly inserted into the tapered hole.

The second cylindrical element also has an inertial coupler releasing means comprised of a longitudinal cavity formed within the body of the second element and a weight loosely disposed within the longitudinal cavity so as to slide freely along the entire length of the cavity. The weight has a magnitude of heaviness such that sufficient inertial energy is released to disengage the annular rings of the second element from the annular grooves of the first element when the arrow impacts the target stopping quickly by the action of the first element's flange thereby causing the weight to rapidly slide forward within the cavity stopping abruptly against the front extent of the cavity whereby the forward motion of the weight is transferred to the second coupler element independently of the first coupler element thereby causing separation of the second coupler element from the first coupler element.

The snare is comprised of a plurality of flexible filaments fixedly attached to each other at both ends. The filaments are also fixedly attached at one end to the tapered rod of the second coupler element and at the other end to the inside of the hollow space of the first shaft such that the filaments can be stored inside the hollow space while the arrow shafts are coupled. The filaments are of appropriate strength and dimension to deploy outside the hollow space of the first shaft upon separation of the arrow shafts whereby entangling the target with itself and surrounding brush and other objects thereby preventing loss of the target and the arrow.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In as much as the foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

Therefore, it is an object of the present invention to provide a new and improved arrow with deployable snare comprising a two-part hollow shaft having a coupling to releasably connect the two parts; feathered stabilizer means; a nock; an arrowhead and; snare means comprising a plurality of flexible filaments fixedly attached to each other, the filaments also being attached at one end to the inside of one of the hollow shafts, the filaments further being attached at the other end to the inside of the other hollow shaft, the filaments additionally being stowed inside the hollow shaft, the filaments having a length to deploy outside the hollow shaft upon release of the shaft coupling at the time of impact with a target whereby ensnarling the target so as to prevent loss of the target and the arrow.

It is another object of the present invention to provide a new and improved arrow with deployable snare which may be easily and efficiently manufactured and marketed.

It is a further object of the present invention to provide a new and improved arrow with deployable snare which is of a durable and reliable construction.

An even further object of the present invention is to provide a new and improved arrow with deployable snare which is susceptible of a low cost of manufacture with regard to both materials and labor, and which accordingly is then susceptible of low prices of sale to the consuming public, thereby making such arrows economically available to the buying public.

Still yet another object of the present invention is to provide a new and improved arrow with deployable snare which provides in the apparatuses and methods of the prior art some of the advantages thereof, while simultaneously overcoming some of the disadvantages normally associated therewith.

Still another object of the present invention is to provide a new and improved arrow with deployable snare which is easy to understand and use.

Yet another object of the present invention is to provide a new and improved arrow with deployable snare which is light weight and convenient to carry in the field.

Even still another object of the present invention is to teach a new and improved method for hunting small game whereby the game is tangled within the snare deployed from the arrow whereby the game is prevented from escaping.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention. The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference numerals refer to similar parts throughout the various Figures.

DESCRIPTION OF THE PREFERRED EMBODIMENT

Figure 1:
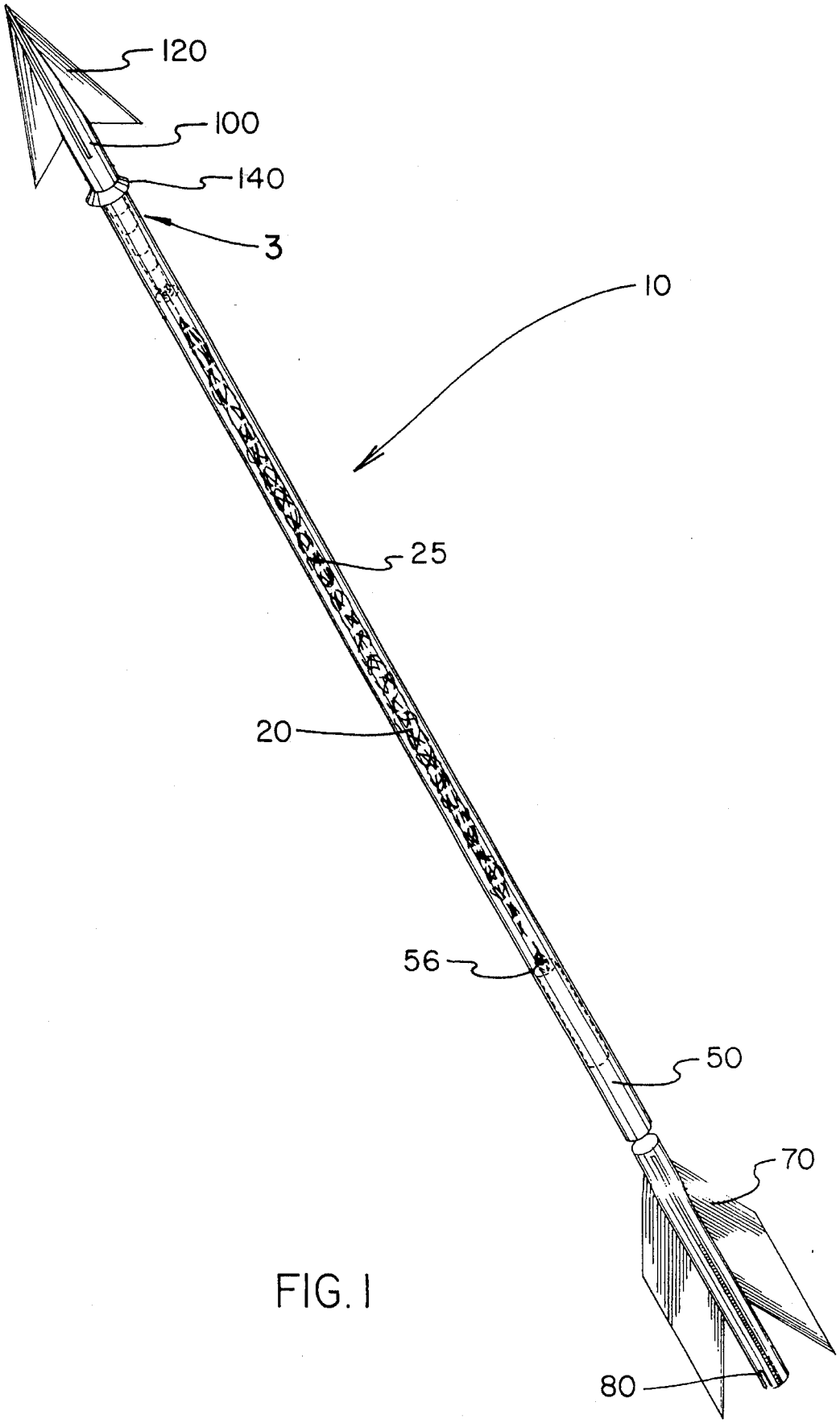
FIG. 1 is a perspective view of the invention.
Figure 2:
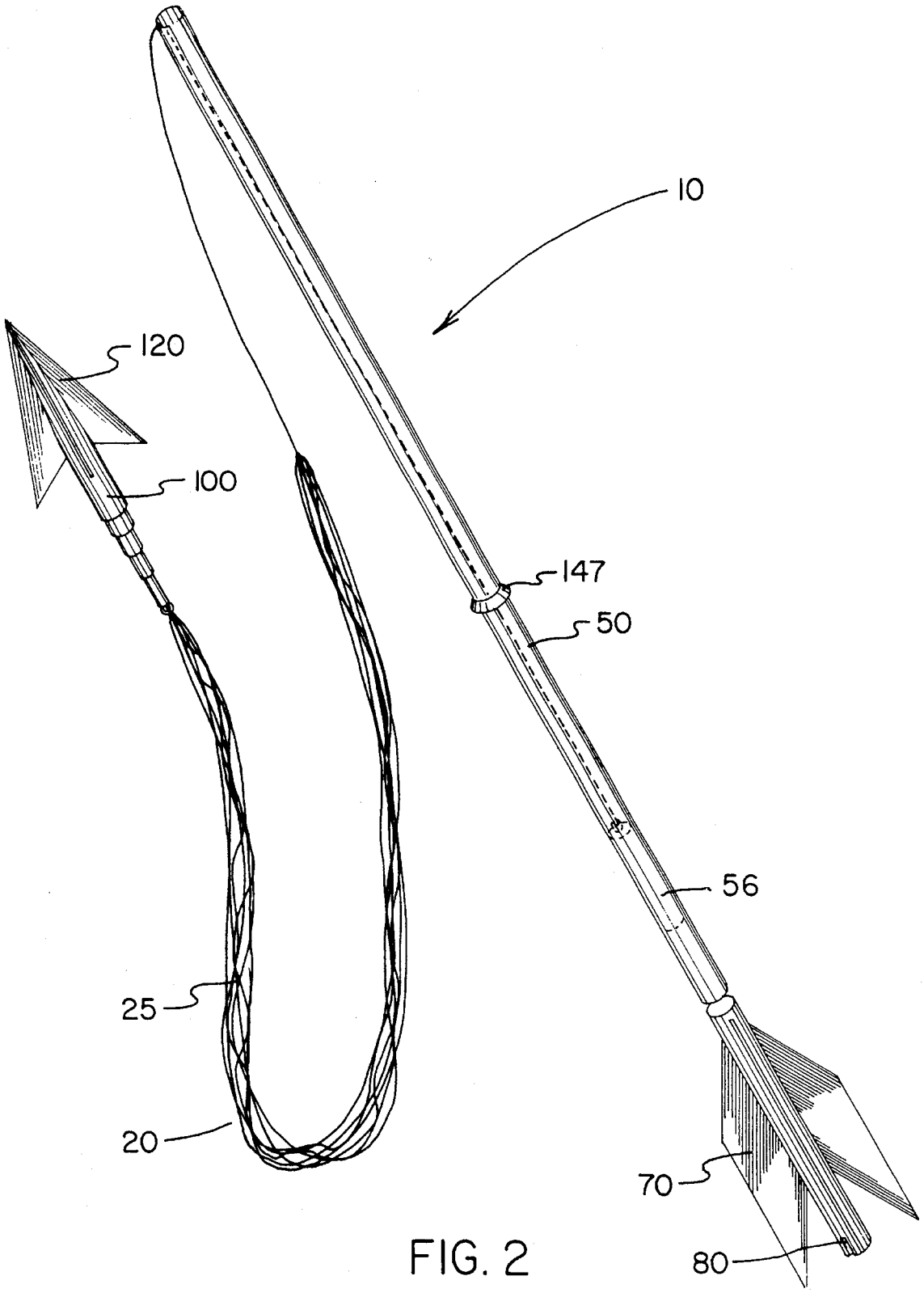
FIG. 2 is a perspective view of the invention illustrating the shaft coupler separated with the snare deployed.

With reference now to the drawings, and in particular to FIG. 1 and FIG. 2 thereof, a new and improved arrow with deployable snare embodying the principles and concepts of the present invention and generally designated by the reference numeral 10 will be described.

From an overview standpoint, the arrow with deployable snare is adapted for use by an archer to entangle a target being struck whereby preventing loss of the target and the arrow. The arrow with deployable snare comprises a two-part hollow shaft having a coupling to releasably connect the two parts, a feathered stabilizer, a nock, an arrowhead, and a snare comprising a plurality of flexible filaments fixedly attached to each other. The filaments are attached at one end to the inside of one of the hollow shafts and at the other end to the inside of the other hollow shaft. The filaments are stowed inside the hollow shaft and have a length to deploy outside the hollow shaft upon release of the shaft coupling at the time of impact with a target whereby ensnarling the target so as to prevent loss of the target and the arrow.

With reference now to FIGS. 1 and 2 and more specifically, it will be noted that a new and improved arrow with deployable snare 10 is comprised of a first tubular shaft 50 having an outside diameter 51 and an inside diameter 53 wherein a hollow space 55 is formed. The first shaft 50 further has a wall 57 defined by the difference between the outside diameter and the inside diameter. The first shaft 50 additionally has feathered stabilizer 70 fixedly attached to one end, a nock 80 fixedly attached to the same end as the feathered stabilizer, and an open end 59 opposite the nock.

Again referring to FIGS. 1, and a second tubular shaft 100 has essentially the same outside diameter as the first shaft 101 and essentially the same inside diameter as the first shaft 103 wherein a hollow space 105 is formed also has a wall 107 defined by the difference between the outside diameter and the inside diameter. The second shaft further has an arrowhead 120 fixedly attached to one end and an open end 109 opposite the arrowhead.

The arrow with deployable snare 10 also includes a means 140 to releasably couple the first shaft 50 to the second shaft 100 so when the first and second shafts are in coupled relationship they are aligned colinearly. Referring once more to FIGS. 1, 3, and 4, the coupler 140 comprises a cylindrical first element 146 having a body 143 with an outside diameter 145 essentially the same as the inside diameter of the first shaft 53. The first element 146 is fixedly attached to the open end of the first shaft 59 so the body is contained entirely within the hollow space of the first shaft 55. A flange 147 is formed on one end of the body 143 external to the first shaft 50 to stop the arrow 10 from passing entirely through a target thereby preventing loss of the arrow. As the arrow contacts a target, the flange slides rewardly along the shaft to limit penetration into the target. The first element 146 additionally has a longitudinal tapered hole 149 therethrough, the tapered hole having a fixed taper angle 141 with the largest opening 151 at the end of the element having the flange 147. The tapered hole 149 also has an inside diameter 148 with two spaced annular grooves 153 and 155 formed thereon.

Still referring to FIGS. 1 and 2 a second cylindrical element 170 having a body 173 with an outside diameter 175 essentially the same as the inside diameter of the second shaft 103 is fixedly attached to the open end of the second shaft 109 so the body 173 is contained entirely within the hollow space of the second shaft 105. The second element 170 also has a tapered rod 177 extending from one end external to the second shaft 100. The tapered rod has a common axis with the body of the second cylindrical element 173. The tapered rod 177 also has an outside diameter 179 and a taper angle 181 essentially complimentary to the inside diameter 148 and taper angle 141 of the first element's longitudinal tapered hole 149. The tapered rod 177 additionally has two spaced annular rings 181 and 183 formed thereon, the annular rings being configured to cooperatively releasably snapidly engage with the annular grooves 153 and 155 of the first coupler element 146 when the tapered rod 177 is forcibly inserted into the tapered hole 149. The second cylindrical element 170 also has an inertial coupler releasing means 200.

Figure 3:
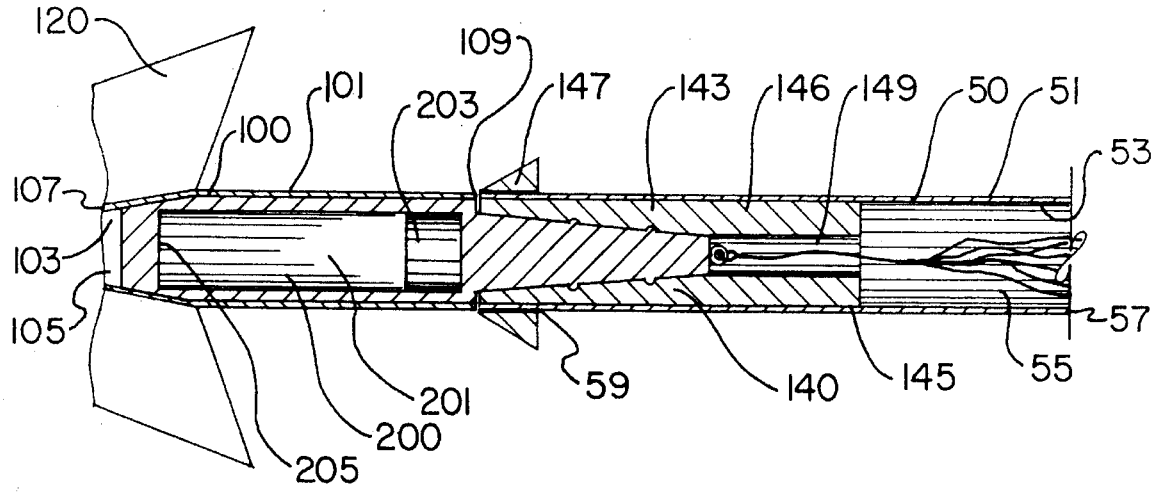
FIG. 3 is a partial sectional view of the arrow illustrating the hollow shaft parts, the inertial coupler-releasing weight in the rearward position.
Figure 4:
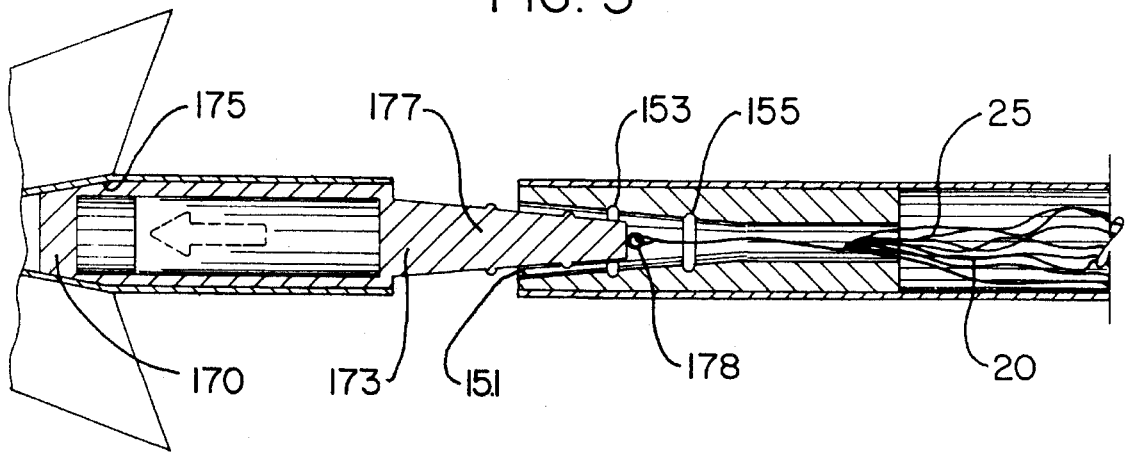
FIG. 4 is a partial sectional view of the arrow illustrating the hollow shaft parts, the inertial coupler-releasing weight in the forward position, and the partially released inertial releasing shaft coupler.
Figure 5:
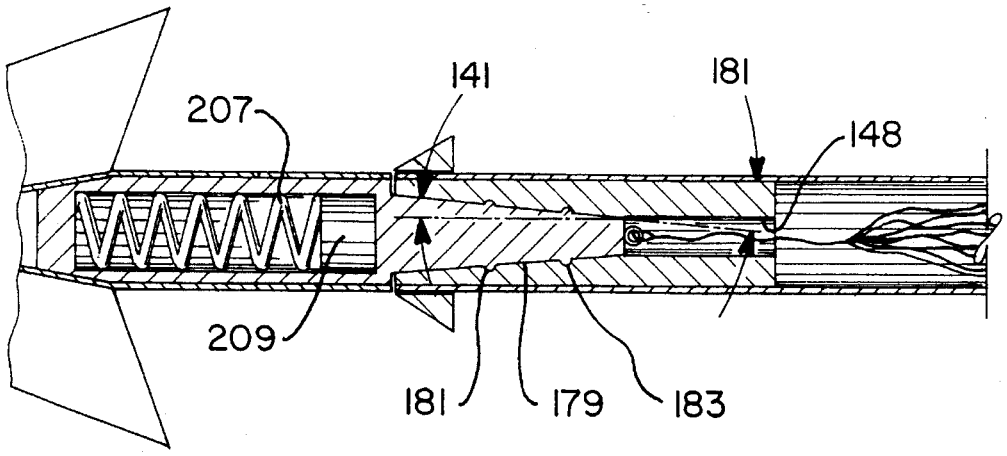
FIG. 5 is a partial sectional view illustrating a first modification of the arrow and the inertial releasing shaft coupler in which an inertial coupler-releasing weight biasing spring is included.

Referring to FIGS. 3, 4 and 5 the inertial coupler releaser 200 is comprised of a longitudinal cavity 201 formed within the body of the second element 173 and a weight 203 loosely disposed within the longitudinal cavity 201 so as to slide freely along the entire length of the cavity. The weight 203 has a magnitude of heaviness such that sufficient inertial energy is released to disengage the annular rings 181 and 183 of the second element 170 from the annular grooves 153 and 155 of the first element 146 when the arrow 10 impacts the target stopping quickly by the action of the flange 147 thereby causing the weight 203 to rapidly slide forward within the cavity 201 stopping abruptly against the front extent of the cavity 205 whereby the forward motion of the weight 203 is transferred to the second coupler element 170 independently of the first coupler element 140 thereby causing separation of the second coupler element from the first coupler element.

The snare 20, as shown in FIGS. 1 and 2 is comprised of a plurality of flexible filaments 25 fixedly attached to each other at both ends. The filaments are also fixedly attached at one end to the tapered rod of the second coupler element 178 and at the other end to the inside of the hollow space 56 of the first shaft 50 such that the filaments 25 can be stored inside the hollow space 55 while the arrow shafts 50 and 100 are coupled. The filaments 25 are of appropriate strength and dimension to deploy outside the hollow space 55 of the first shaft upon separation of the arrow shafts 50 and 100 whereby entangling the target with itself and surrounding brush and other objects thereby preventing loss of the target and the arrow 10.

In a second embodiment, as shown in FIG. 5, it will be noted that the inertial coupler releasing means 200 includes a means to bias 207 the weight 203 toward the rear of the cavity 209 at all times except when the arrow 10 impacts the target whereby preventing the weight 203 from acting in reverse during launch of the arrow from a bow (not shown) thereby causing unwanted slowing of the arrow during launch.

Figures 6, 7:
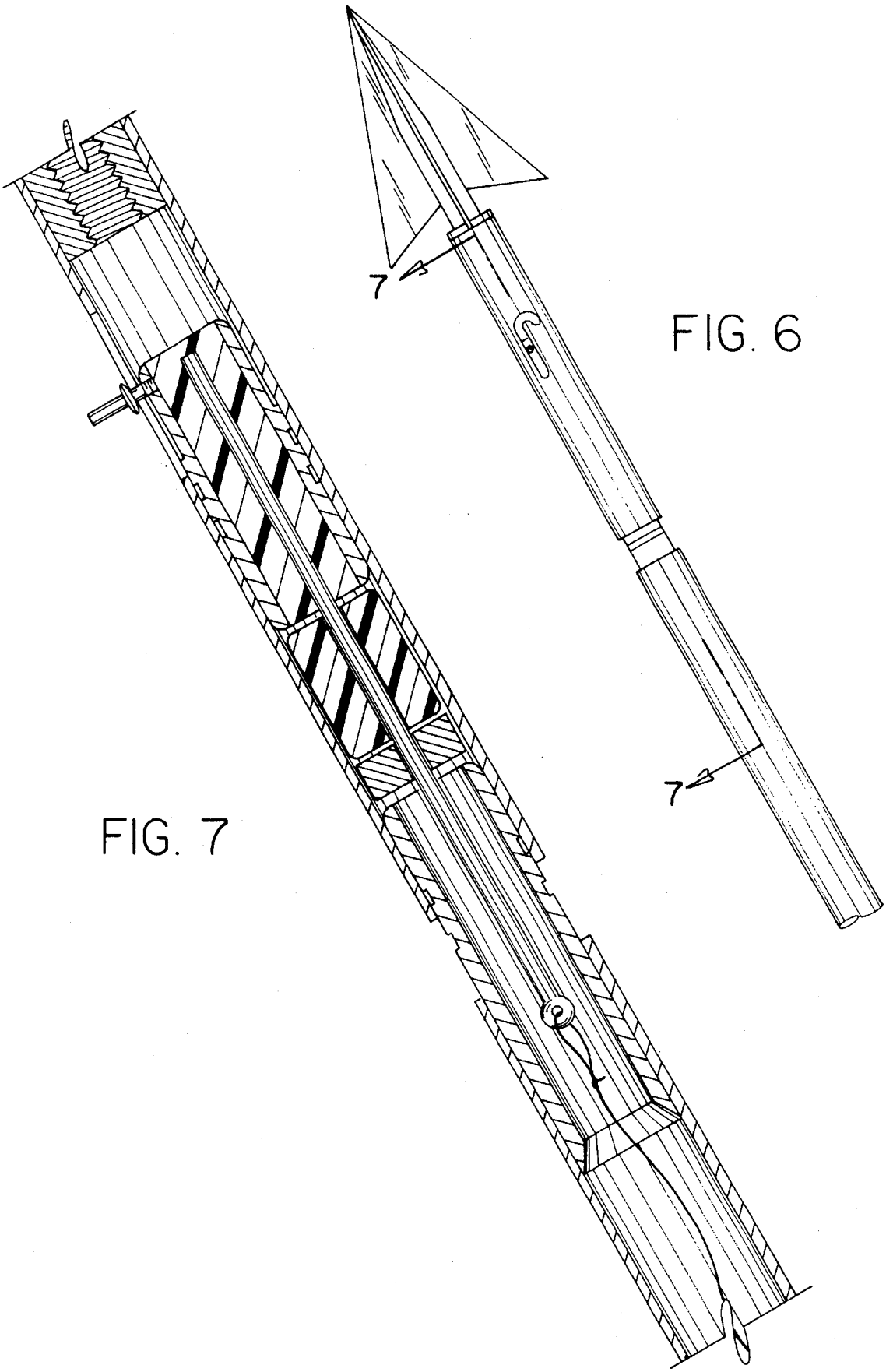
FIG. 6 is a partial perspective view of an alternate embodiment of the invention.
FIG. 7 is a cross-sectional view taken along line 7—7 of FIG. 6.

Shown in FIGS. 6 and 7 is a third alternate embodiment of the invention. As can be seen in the cross-sectional view of FIG. 7, beginning at the point end, there is disclosed an arrow 300 with a triggering mechanism 301. The triggering mechanism includes a pin 302 located toward the forward point end. When the target is hit, the pin 302 is moved rearwardly toward the fletching. This will initiate and effect separation of the front arrow half 304 from the rear arrow half 305. The cylinder 306 holding the two halves of the arrow together then becomes disengaged by sliding away from the front arrow half.

The pin 302 is threaded at its interior end for mating with threads in the forward plunger mechanism 307. The plunger assembly 311 includes the forward plunger mechanism 307, the rearward plunger mechanism 308, and a nylon spacer 309 therebetween for absorbing vibrations. Rearward movement of the pin 303 moves the coupled plunger assembly 311 rearwardly to thereby push the rear arrow half rearwardly to effect separation of the two arrow halves.

A rod 310 extends axially through the center of the entire plunger assembly 311 in the front arrow half and has a rearwardly extending central bore 312 for receiving the forward end of the strands 313 of the monofilament. The halves of the arrow must be machined precisely for proper alignment during operation and use, particularly at the area where they abut.

A pin guide and locking mechanism 315 is also included. The locking mechanism is effected by providing a linear extent of the slot 316 in the arrow through which the pin 302 extends and forming the slot with a curved or J-shaped end 317 adjacent to its forward end. Consequently, when the pin is moved forwardly and into the short part of the J-shaped end, the pin and arrow are in a locked orientation so as to preclude relative movement and to preclude separation of the arrow halves in the event of inadvertent movement of the arrow with respect to a target or other object.

The monofilament 313 couples the front and rear arrow halves as in the prior embodiment. The coupling monofilament may be re-utilized after various uses. In such case, the monofilament would be pushed into the central aperture 324 of the bearing cylinder 306. Such cylinder is fixedly positioned within the rear arrow half 305 which, like the front arrow half, is of a tubular configuration. The bearing cylinder 306 is of an exterior diameter at its forward end to frictionally engage the rearward end of the forward half of the arrow until separation therebetween is effected through the striking of the target and the movement downwardly of the pin. The rearward end of the bearing cylinder 306 is press fit for essentially permanent coupling with the interior of the rear arrow half.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A new and improved arrow with deployable snare comprising:

a first tubular shaft having an outside diameter, the first shaft also having an inside diameter wherein a hollow space is formed, the first shaft further having a wall defined by the difference between the outside diameter and the inside diameter, the first shaft additionally having feathered stabilizer means fixedly attached to one end, the first shaft also having a nock fixedly attached to the same end as the feathered stabilizer means, the first shaft having an open end opposite the nock;

a second tubular shaft having essentially the same outside diameter as the first shaft, the second shaft also having essentially the same inside diameter as the first shaft wherein a hollow space is formed, the second shaft further having a wall defined by the difference between the outside diameter and the inside diameter, the second shaft further having an arrowhead fixedly attached to one end, the second shaft additionally having an open end opposite the arrowhead;

coupler means to releasably couple the first shaft to the second shaft so when the first and second shafts are in coupled relationship they are aligned colinearly, the coupler means comprising:

a cylindrical first element having a body with an outside diameter essentially the same as the inside diameter of the first shaft, the first element being fixedly attached to the open end of the first shaft so the body is contained entirely within the hollow space of the first shaft, the first element also having a flange formed external to the first shaft to stop the arrow from passing entirely through a target thereby preventing loss of the target and the arrow, the first element additionally having a longitudinal tapered hole therethrough, the tapered hole having a fixed taper angle, the tapered hole also having an inside diameter, the tapered hole having a largest opening at the end of the element having the flange, the longitudinal hole also hang two spaced annular grooves formed therein;

a second cylindrical element having a body with an outside diameter essentially the same as the inside diameter of the second shaft, the second element fixedly attached to the open end of the second shaft so the body is contained entirely within the hollow space of the second shaft, the second element also having a tapered rod having a common axis with the body of the second cylindrical element, the tapered rod also having an outside diameter and a taper angle essentially complimentary to the inside diameter and taper angle of the first element's longitudinal tapered hole, the tapered rod additionally having two spaced annular rings formed thereon, the annular rings being configured to cooperatively releasably snapidly engage with the annular grooves of the first coupler element when the tapered rod is forcibly inserted into the tapered hole, the second cylindrical element also having an inertial coupler releasing means comprising:

a longitudinal cavity formed within the body of the second element, a weight loosely disposed within the longitudinal cavity so as to slide freely along the entire length of the cavity, the weight having a magnitude of heaviness such that sufficient inertial energy is released to disengage the annular rings of the second element from the annular grooves of the first element when the arrow impacts the target stopping quickly by the action of the first element's flange thereby causing the weight to rapidly slide forward within the cavity stopping abruptly against the front extent of the cavity whereby the forward motion of the weight is transferred to the second coupler element independently of the first coupler element thereby causing separation of the second coupler element from the first coupler element; and snare means comprising:

a plurality of flexible filaments fixedly attached to each other at both ends, the filaments also being attached at one end to the tapered rod of the second coupler element, the filaments further being fixedly attached at the other end to the inside of the hollow space of the first shaft such that the filaments can be stored inside the hollow space while the arrow shafts are coupled, the filaments also being of appropriate strength and dimension to deploy outside the hollow space of the first shaft upon separation of the arrow shafts whereby entangling the target with itself and surrounding brush and other objects thereby preventing loss of the target and the arrow.

2. The new and improved arrow with deployable snare of claim 1 wherein the inertial coupler releasing means includes a means to bias the weight toward the rear of the cavity at all times except when the arrow impacts the target whereby preventing the weight from acting in reverse during launch of the arrow from a bow thereby causing unwanted slowing of the arrow during launch.

3. A new and improved arrow with deployable snare comprising:

a two-part hollow shaft having a coupling to releasably connect the two parts, the two parts including a forward part and a rearward part;

feathered stabilizer means;

a nock; and snare means comprising:

a plurality of flexible filaments fixedly attached to each other, the filaments also being attached at one end to the inside of one of the hollow shafts, the filaments further being attached at the other end to the inside of the other hollow shaft, the filaments additionally being stowed inside the hollow shaft, the filaments having a length to deploy outside the hollow shaft upon release of the shaft coupling at the time of impact with a target whereby ensnaring the target so as to prevent loss of the target and arrow.

4. A new and improved arrow with deployable snare comprising:

a two-part hollow shaft having a coupling to releasably connect the two parts, the two parts including a forward part and a rearward part;

feathered stabilizer means and a nock on the rearward part;

an arrowhead on the forward part with a slidable bearing therein; and a snare between the forward and rearward parts, the snare comprising:

a flexible filament fixedly attached at one end to the inside of one of the hollow shafts, the filament further being attached at the other end to the inside of the other hollow shaft, the filament additionally being stowed inside the hollow shaft, the filament having a length to deploy outside the hollow shaft upon release of the shaft coupling at the time of impact with a target whereby ensnaring the target so as to prevent loss of the target and the arrow and a pin extending radially outward from the forward part and having an exterior end movable rearwardly upon making contact with the target, the inner end of the pin being coupled to the bearing to facilitate separation of the two parts.

5. The apparatus as set forth in claim 4 and further including an axial slot in the forward part for guiding the motion of the pin, the slot having a curved semi-circular portion at the forward end for creating a locking zone for the pin.

* * * * *